US006905417B1

(12) United States Patent
Tona et al.

(10) Patent No.: US 6,905,417 B1
(45) Date of Patent: Jun. 14, 2005

(54) AUTOMATIC POOL CUE TIP TAPPER

(76) Inventors: Johnny A. Tona, 2503 Pansy St., Huntsville, AL (US) 35801; David M. Brazier, 107 Brookstone La., Madison, AL (US) 35758; Robert W. Hall, 107 Brookstone La., Meridianville, AL (US) 35759

( * ) Notice: Subject to any disclaimer, the term of this patent is extended or adjusted under 35 U.S.C. 154(b) by 0 days.

(21) Appl. No.: 10/649,071

(22) Filed: Aug. 27, 2003

Related U.S. Application Data

(60) Provisional application No. 60/406,198, filed on Aug. 27, 2002.

(51) Int. Cl.[7] ..... A63D 15/00; A63D 15/16; B27L 9/00

(52) U.S. Cl. ..... 473/36; 473/1; 30/494

(58) Field of Search ..... 473/1, 34–39; 30/494; 222/634; D21/726; 451/28

(56) References Cited

U.S. PATENT DOCUMENTS

| | | | | |
|---|---|---|---|---|
| 737,226 | A * | 8/1903 | Guese | 473/37 |
| 4,827,618 | A | 5/1989 | Lynn | |
| 5,129,187 | A * | 7/1992 | Cain | 451/28 |
| 5,208,985 | A | 5/1993 | Carter | |
| 5,228,160 | A * | 7/1993 | Porper | 7/158 |
| 5,417,503 | A * | 5/1995 | Brennan, III | 401/92 |
| 5,545,093 | A | 8/1996 | Contestabile | |
| 5,865,682 | A | 2/1999 | Sutton | |
| 6,341,399 | B2 | 1/2002 | Method | |
| 6,602,143 | B2 * | 8/2003 | Pettigrew | 473/1 |
| 6,616,540 | B2 * | 9/2003 | Slacum | 473/36 |

* cited by examiner

*Primary Examiner*—Mitra Aryanpour
(74) *Attorney, Agent, or Firm*—Joseph H. Beumer

(57) ABSTRACT

A pool cue tip conditioning device has a striker plate carrying tip-indenting fingers on its bottom side, the plate located for being driven into a pool cue tip to indent the tip without damaging it. The striker plate is driven by a plunger controlled by a return spring. A plug is located above the plunger, the plug having an aperture in a bottom surface for receiving the tip of the plunger when the post of the plunger is centered. The plug is held off-center by an aysmmetric return spring which allows the tip of the post to become centered and to move upward into the aperture when the striker plate is moved upward by insertion of a pool cue. A work spring stronger than the return spring then forces the plug downward, slamming into the plunger, which drives the striker plate into the cue tip.

10 Claims, 5 Drawing Sheets

AUTOMATIC POOL CUE TIP TAPPER

CROSS REFERENCE TO RELATED APPLICATION

This application claims the benefit of Provisional Application Ser. No. 60/406,198, filed Aug. 27, 2002.

FIELD OF THE INVENTION

This invention relates to devices for conditioning pool cue tips and more particularly to devices for treating pool cue tips to penetrate and remove a layer of glazed chalk and/or to create a pattern of minute depressions into which additional chalk may be received and retained.

BACKGROUND OF THE INVENTION

Various approaches to conditioning of pool cue tips have been taken, most of which involve some form of cutting, scuffing or piercing the tip leather and thus shortening its useful lifetime. In addition to this disadvantage, considerable skill is required to apply a tool with an exact and consistent amount of force so as to obtain a playable surface without damaging the leather. It would be preferable to provide a device that creates impressions capable of receiving chalk in the tip surface without inflicting damage.

SUMMARY OF THE INVENTION

The present invention is directed to a pool cue tip conditioning device comprising a series of components aligned in a generally tubular housing adapted for use in a vertical configuration, with the lower end of the device being pulled downward over a pool cue tip. A striker plate is slidably mounted adjacent the lower end of the housing, the plate on its lower side supporting an array of tip-indenting members and on its upper side having a contact knob for receiving blows from a plunger. The plunger, slidably mounted above the plate, has a flat bottom surface engaging the knob and an upper surface upon which a vertically extending post is mounted. The post is configured to engage a return spring which has a characteristic of causing the tip end of the post to be centered when pressure is applied by forcing the housing downward over a pool cue tip. A plug is provided between a work spring secured by an upper end of the housing and the upper end of the return spring, the plug at its bottom surface having an axially extending central aperture into which the upper end of the post is directed by action of the return spring upon application of pressure, which action results from structural features of the return spring. In particular, the return spring may comprise a generally triangular shaped compression spring having an off-axis bend at its smaller end and upper and lower turns of the spring substantially out of parallel with each other. When pressure is not being applied to the return spring, the plunger tip rests against a lower surface of the plug away from the central aperture, restraining the striker plate from movement.

Once pressure is applied, the plunger tip is centered by internal features of the main body, causing the tip to be released for movement into the plug aperture upward to the upper end thereof. At this point a work spring, substantially stronger than the return spring, forces the plug downward, slamming it back into the plunger, which in turn drives the striker plate into the cue tip over which the lower end of the device is placed. The force delivered in carrying out this action depends on the strength of the work spring in comparison with the return spring, and does not vary with the force exerted by a specific user. Less skill in application of force is therefore required. For best results a relative spring strength sufficient to create indentations capable of holding chalk without inflicting damage to the tip is preferred.

It is accordingly an object of this invention to provide a pool cue tip tapper device that delivers tip-striking blows of consistent strength, independent of skill on the part of the user.

Another object is to provide such a device that forms chalk-retaining indentations in a cue tip without inflicting damage to the tip.

Another object is to provide a pool cue tapper in which the force of application of striking blows is determined by relative strength of springs, rather than by mechanical skill of the user.

Other objects and advantages of the invention will be apparent from the following description and the appended claims.

DESCRIPTION OF THE PREFERRED EMBODIMENT

Figure 1:
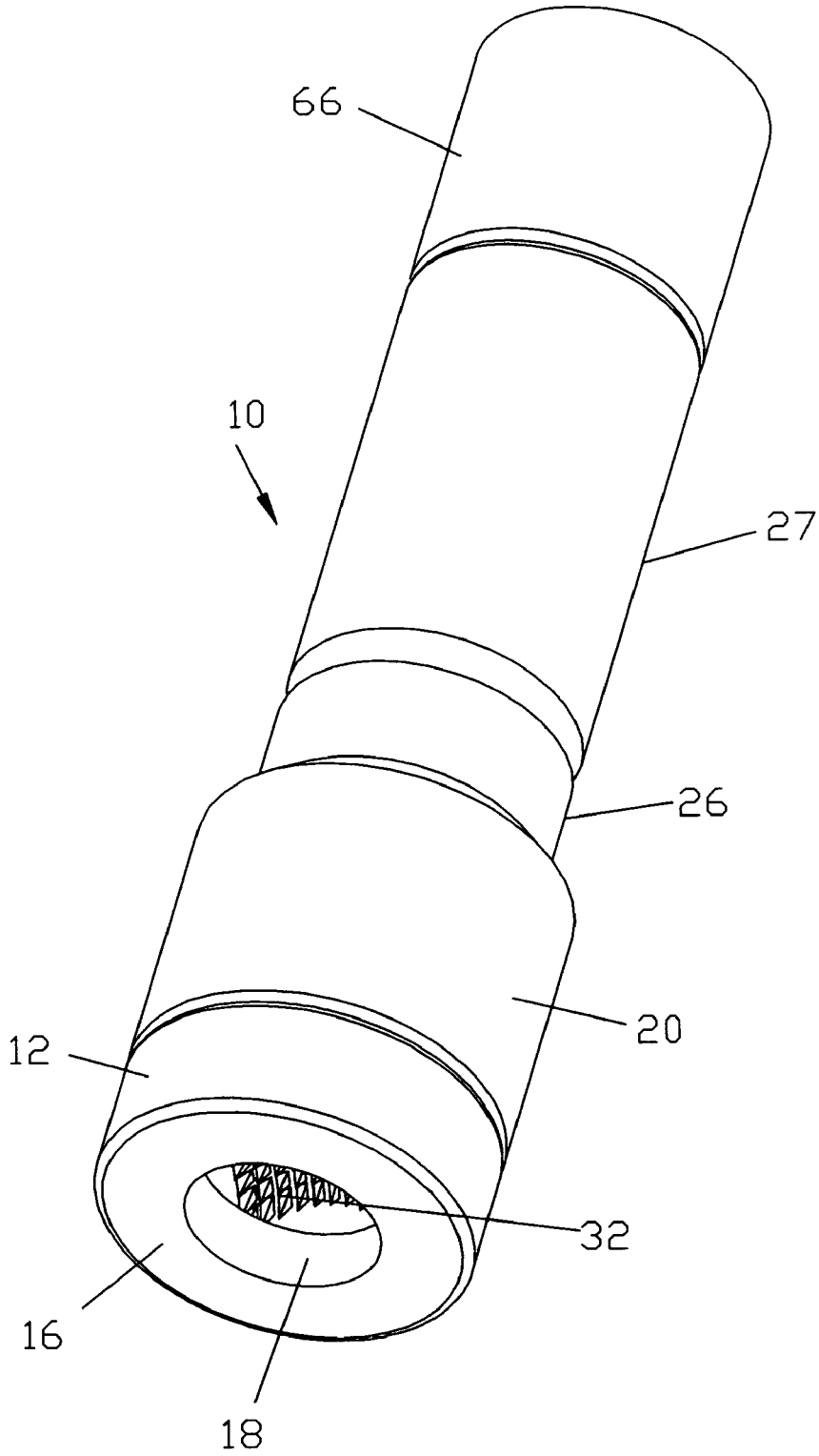
FIG. 1 is a perspective view of a tip-tapper device embodying the invention.

Referring to FIG. 1 of the drawings, there is shown an external view of a pool cue tip conditioning device 10. The device has a bottom housing portion 12, a main body housing portion 27 and a housing cap 66. The main body portion includes a middle portion 26 and a lower sleeve portion 20. Bottom housing portion 12 has an end flange 16 and a central opening 18 in which pool cue tips are received for treatment. An array of projecting fingers 32 are provided to come into contact with pool cue tips in a tapping treatment.

Figure 2:
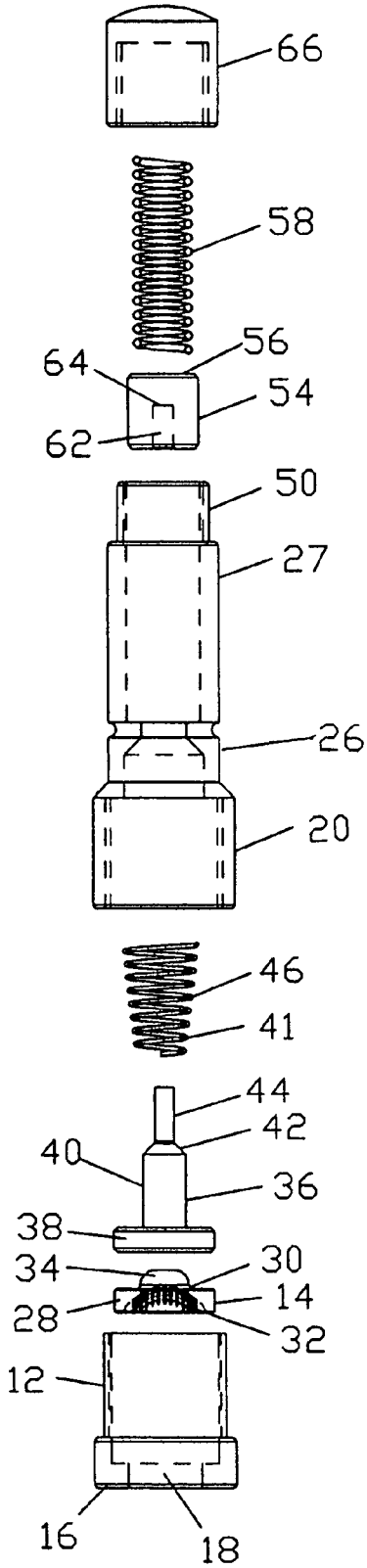
FIG. 2 is an exploded view thereof.

FIG. 2 shows housing parts 12, 27 and 66 positioned at bottom, middle and top positions and internal components in vertical alignment, including a striker plate 14 carried in housing portion 12, a plunger 36 located in position to come into contact with striker plate 14, a return spring 46 disposed over post 40 of the plunger, a plug 54 adapted to receive a tip 44 of the plunger in an aperture 62 at the bottom surface 60 of the the plug upon application of force to striker plate 14 and a work spring 58 urging the plug downward.

Figure 3:
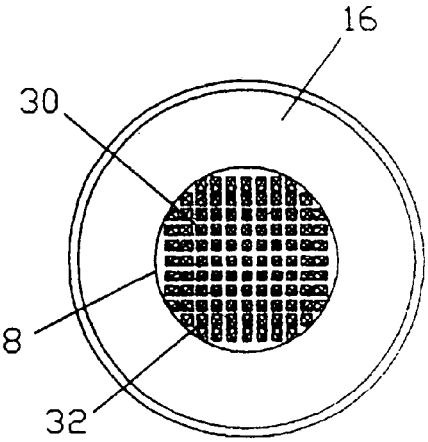
FIG. 3 is an end view showing an array of tapping fingers.

FIG. 3 provides an end view of the device, taken from below, showing a circular flange 16, disposed around a central opening 18 configured to receive a pool cue tip and a concave array 30 of a multiplicity of fingers 32 positioned to produce indentations in inserted cue tips during a tapping procedure.

Figure 4:
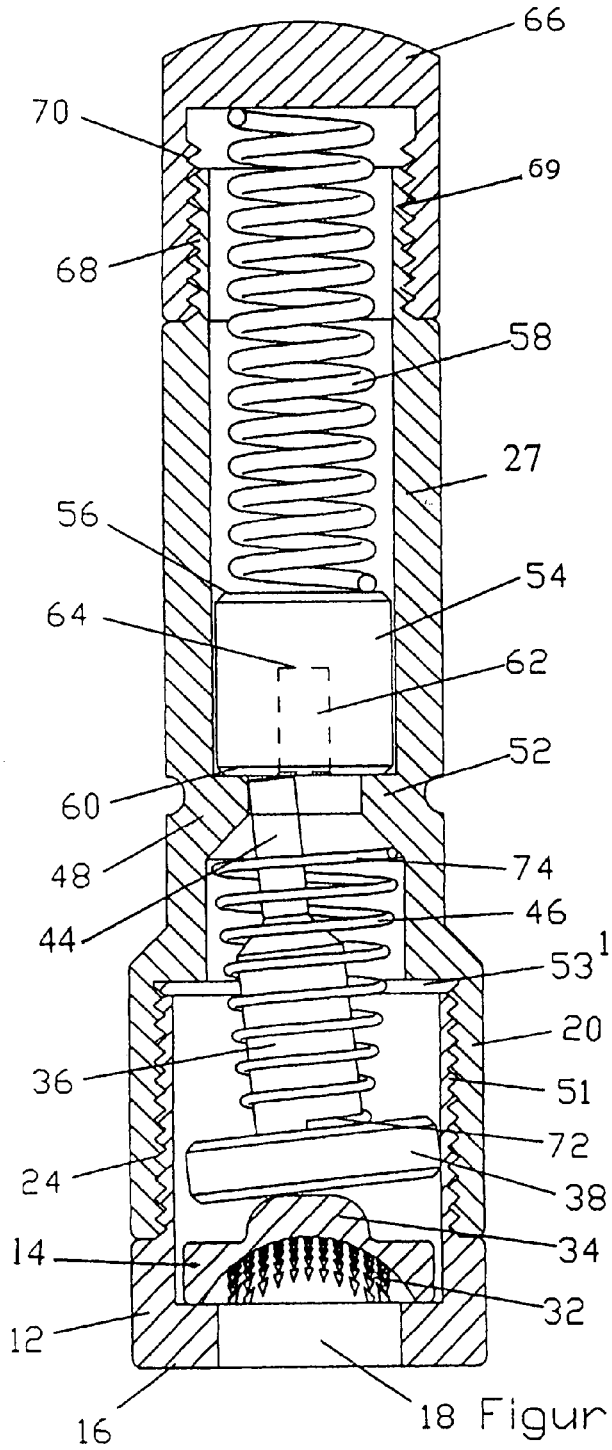
FIG. 4 is a view of the device, partly in section, showing a striker-driving plunger in a restrained position prior to being activated.

FIG. 4 shows the location and alignment of internal components of the device prior to activating the device by applying pressure to the striking plate 14 in a cue tapping procedure. In the configuration of this drawing, tip portion 44 of plunger 36 is restrained from entering aperture 62 of plug 54 by virtue of unique characteristics of return spring 46. In particular, the return spring may comprise a generally triangular compression spring, bent off-axis at its smaller end so that the lower end is bent away from being parallel with the upper end. This causes the plunger tip to be held in contact with the bottom surface of the plug so that it will not become centered and thus will not be allowed to enter the aperture unless a pressure strong enough to overcome the work spring is applied. The work spring 58 has its upper end in contact with housing cap 66 and its lower end in contact with the top surface 56 of plug 54, urging the plug downward.

FIG. 4 also shows connection of main body portion 27 of the housing with cap 66 at the top and with bottom housing portion 12. At the top, external threads 68 of inner member 69 are engaged with internal threads 70 of cap 66, while at the bottom external threads 24 of bottom housing 12 are engaged with internal threads 51 of middle housing portion 26.

In the configuration of FIG. 4 striker plate 14 remains in contact with flange 16 at the base of bottom housing portion 12, inasmuch as the striker has not yet been driven upward by insertion of a cue tip into central opening 18 or by making contact with fingers 32. Knob 34 of the striker allows plunger 36 to be tilted over, with flat disk 38 inclined away from parallel with the striker plate. Return spring 46, in the absence of pressure from below, has its upper end 74 and its lower end 72 tilted away from perpendicular alignment with housing components of the device. FIG. 4 also shows stop collars incorporated in the main housing body 27 to limit movement of operating components. Stop collar 52 limits downward movement of plug 54, and stop collar 53 limits upward movement of plunger 36. Lower surface 60 of plug 54 also restrains plunger tip 44 from upward movement until the plunger tip is centered and allowed to move into aperture 62 of the plug.

Figure 5:
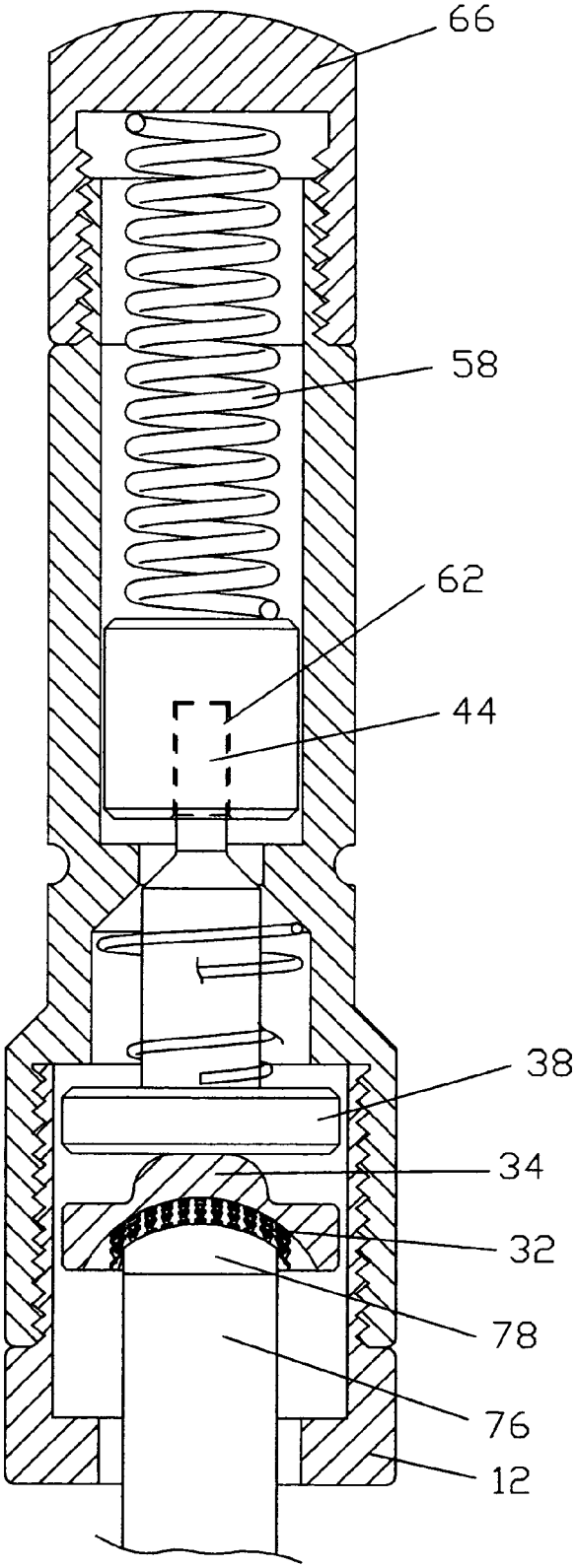
FIG. 5 is a view, partly in section, showing an array of tapping fingers being driven into a cue tip.

FIG. 5 shows the alignment of component parts of the device after a tip 78 of a pool cue 76 has been brought into contact with fingers 32 provided in the lower side of a striker plate 14. Upward movement of cue stick 76 overcomes work spring 58, causing tip 44 to become centered under aperture 62 of plug 54 by guiding action of return spring 46. Upon being located in alignment with the aperture 62, tip 44 is released for movement. The work spring 58, being substantially stronger than the return spring, forces the plug downward over the tip until the tip comes into contact with the end of the aperture. As a result the plug is slammed downward against the plunger 36, which in turn drives fingers 32 of the striker plate into cue tip 78. Relative strengths of the return spring and the work spring may be chosen to obtain formation of indentations of the cue tip without penetrating the leather of the cue tip in a manner such as to inflict damage.

Figure 6:
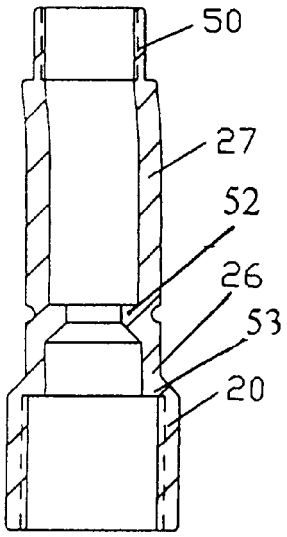
FIG. 6 is a sectional view of a main body housing of the device.

The main body portion 27 of the housing for the device is shown in FIG. 6. This component has an upper sleeve 50 provided with threads for engagement with a cap and a lower sleeve portion 26 also provided with threads for being connected to bottom housing portion 12. Two stop collars are preferably incorporated in the main body portion to limit the extent of movement of operating components. Lower stop collar 53 limits upward movement of the plunger, and upper stop collar 52 limits downward movement of the work spring.

Figure 7:
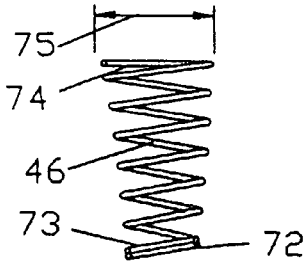
FIG. 7 is a side view of a return spring used in the device.

FIG. 7 shows details of a suitable return spring for use in the preferred embodiment. Although the invention is not limited to specific dimensions of components, the return spring 46, which is a generally triangular compression spring with a bent-off axis at its smaller end, may have a diameter 75 at its upper end 74 of 0.625 inch and at its lower end 72 a diameter of 0.350 inch. Overall expanded length as shown is 1.10 inch. At its lower end the spring is bent away from being parallel with the upper end to the extent of 15 to 20 degrees. The return spring preferably is comprised of a 0.032 inch music wire and may have 7 to 9 turns in the coil. When pressure is not being applied to this spring at its lower end in which the plunger tip is inserted, the spring holds the plunger tip away from the aperture of the plug. Upon compression of the return spring by force applied to its lower and smaller end the spring and plunger become aligned symmetrically and are centered, allowing the plunger to move freely into the aperture of the plug.

Figure 8:
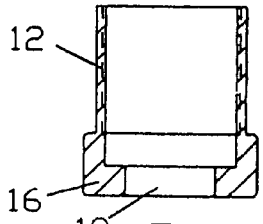
FIG. 8 is a sectional view of a bottom housing portion thereof.

FIG. 8 is directed to bottom housing portion 12, which includes an end flange 16 and a central opening 18 for insertion of cue sticks to enable tapping of tips on the sticks. External threads are provided on this portion for making connection with mating internal threads on the main body portion of the housing.

Figure 9:
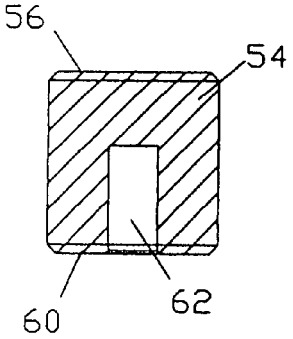
FIG. 9 is a sectional view of a plug with an aperture into which the plunger tip is driven.

FIG. 9 shows a plug 54 contacted from above by work spring 58 and from below by plunger tip 44, which bears against lower surface 60 of the plug or against the upper end of aperture 62 upon being centered as described above.

Figure 10:
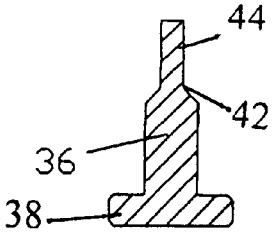
FIG. 10 is a sectional view of the plunger.
Figure 13:
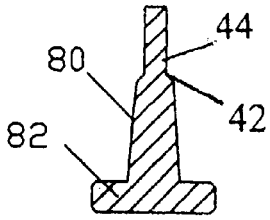
FIG. 13 is a sectional view of an alternate plunger design.

FIG. 10 and FIG. 13 show two versions of plungers which may be used. Each of these plungers (out of scale with other components) have a cylindrical upper tip portion 44 sized to fit into aperture 62 of the plug and a circular flat bottom disk 38, 82 sized to fit within lower housing portion 12. Lower post portion 36, 80 receives the lower end portion of the return spring, the lower post portion 36, 80 being cylindrical as in the plunger of FIG. 10 or frustro-conical as in FIG. 13. Each of the plungers have a transition zone 42 between upper and lower portions of the post.

Figure 11:
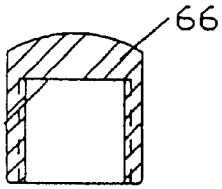
FIG. 11 is a sectional view of a cap for the tapper housing.

FIG. 11 shows a cap 66 fror placement on the main body of the housing. Internal threads are provided for engagement with external threads at the upper end of the main body.

Figure 12:
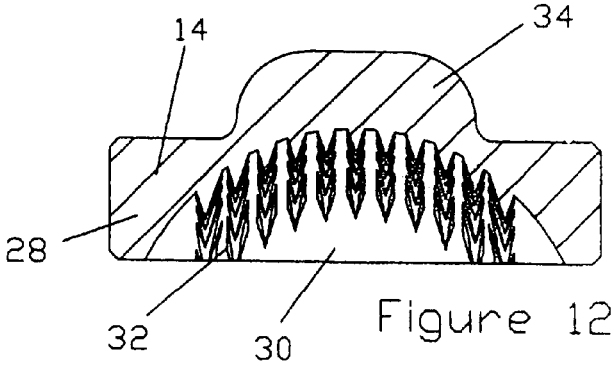
FIG. 12 is an enlarged sectional view of a striker plate and an array of fingers.

As shown in the enlarged view of FIG. 12 the striker plate 14, which fits across the interior of bottom housing portion 12, has a metal disk 28 with a concave pocket at its lower side and an arcuate knob on its topside. An array 30 of fingers 32 are disposed within the pocket and are arranged to have their points form a concave pattern conforming to the rounded shape of a pool cue tip. The metal disk 28 may have a thickness of 0.200 inch, and the rounded knob 34 may have a thickness of 0.150 inch at its center and a diameter of 0.400 inch. Fingers 32 are preferably pyramidical in shape, having a height of 0.040 inch, and are located on 0.050 inch centers. Points of the fingers may have an angle of 40 degrees with relation to horizontal. Curvature at a radius of 0.390 inch provides a suitable rounded shape for the pocket.

Suitable dimensions for housing components may include the following: the cap—an overall length of 1 inch, an internal height of 0.700 and a diameter of 0.910 inch; the main body—an internal diameter of 0.600 inch, external diameter of 1.160 inch, threaded upper portion of main body, height 0.500 inch; height above upper stop collar, 2.00 inches; bottom, internally threaded portion of main body, height of 0.900 inch. Lower stop collar defines internal passage with diameter of 0.370 inch. Below this stop collar the main body housing has a diameter of 0.650 inch extending to threaded portion, where diameter is 0.675 inch.

For the embodiment described above the work spring may comprise a compression spring made of 0.050 inch music wire having an expanded length of 2¼ inches. The housing is preferably made of polycarbonate formed by injection molding. The striker plate may be made of an aluminum alloy such as 7075 or harder alloy fabricated by computer-aided machining.

While the preferred embodiment has been described above in specific terminology, this description is for illustrative use only, and it is to be understood that the invention is limited only as indicated by the appended claims.

What is claimed is:

1. A pool cue tip conditioning device comprising:

a housing having an upper end limiting upward movement of components contained therein, a lower end having defined therein an opening enabling insertion of a pool cue into the device and a body portion disposed between said ends;

a striker plate slidably disposed above said lower end, said plate comprising a base member extending across said housing, a multiplicity of tip-indenting fingers arranged in a concave array connected to a lower side of said base member and a contact member located at a central location on a top side of said base member;

a plunger slidably disposed above said striker plate, said plunger comprising a disk having a bottom surface in position for being contacted by said contact member and said plunger having connected to a topside thereof a post including a lower part and a tip;

a plug located above said plunger, said plug having defined in a central location of a bottom surface thereof an aperture conforming to said tip of said plunger whereby said tip may be moved to fit into said aperture upon being centered;

a return spring disposed around a periphery of said post, said return spring including non-parallel turns biasing said post off-center whereby said tip of said plunger remains in contact with a bottom surface of said plug in the absence of pressure applied to said striker plate; and a work spring urging said plug downward.

2. The device as defined in claim 1 wherein said contact member on a top side of said striker plate comprises a rounded knob.

3. The device as defined in claim 1 wherein relative strength of said work spring asserts a stronger force than said return spring.

4. The device as defined in claim 3 wherein said work spring is comprised of 0.050 inch music wire.

5. The device as defined in claim 4 wherein said return spring is comprised of 0.032 inch music wire.

6. The device as defined in claim 3 wherein said return spring has a generally triangular shape.

7. The device as defined in claim 6 wherein said return spring has an upper end and a lower end and said lower end is bent away from parallel alignment with said upper end to an extent of 15 to 20 degrees.

8. The device as defined in claim 1 wherein said fingers are pyramidical in shape and have a height of 0.700 inch.

9. The device as defined in claim 1 wherein said fingers are located on 0.050 inch centers.

10. The device as defined in claim 1 including a lower stop collar limiting upward movement of said plunger and an upper stop collar limiting downward movement of said plug.

* * * * *